US010613467B2

(12) United States Patent
Kimura

(10) Patent No.: US 10,613,467 B2
(45) Date of Patent: Apr. 7, 2020

(54) INFORMATION PROCESSING APPARATUS

(71) Applicant: Oki Data Corporation, Tokyo (JP)

(72) Inventor: Toshiyuki Kimura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/034,396

(22) Filed: Jul. 13, 2018

(65) Prior Publication Data

US 2019/0033776 A1 Jan. 31, 2019

(30) Foreign Application Priority Data

Jul. 25, 2017 (JP) ..... 2017-143718

(51) Int. Cl.
*G03G 21/16* (2006.01)

(52) U.S. Cl.
CPC ..... *G03G 21/1628* (2013.01); *G03G 21/1633* (2013.01)

(58) Field of Classification Search
CPC ..... G03G 21/1623; G03G 21/1628; G03G 21/1633; G03G 21/1638; G03G 15/1605
See application file for complete search history.

(56) References Cited

U.S. PATENT DOCUMENTS 5,787,326 A * 7/1998 Ogawa ..... G03G 15/1605 399/121
2009/0226190 A1* 9/2009 Asaba ..... G03G 15/70 399/16
2010/0315658 A1* 12/2010 Niikawa ..... G03G 21/1628 358/1.5

FOREIGN PATENT DOCUMENTS

JP 2007-065125 A 3/2007

* cited by examiner

*Primary Examiner* — Carla J Therrien
(74) *Attorney, Agent, or Firm* — Muncy, Geissler Olds & Lowe, P.C.

(57) ABSTRACT

An information processing apparatus includes an apparatus main body, a rotating member rotatable with respect to the apparatus main body, a protective member to protect a predetermined portion of the rotating member and that includes a first engagement part, and an interlocking part that interlocks the rotating member and the protective member and including a second engagement par. The interlocking part causes the first engagement part and the second engagement part to be engaged with the protective member and the rotating member, and the interlocking part releases the engagement of the first engagement part and the second engagement part when the rotating member is in a predetermined rotation state.

11 Claims, 7 Drawing Sheets

INFORMATION PROCESSING APPARATUS

TECHNICAL FIELD

The present invention relates to an information processing apparatus, and is suitably applied to, for example, a printer or a multifunction machine having a protective member interlocked with a rotating member, such as an opening and closing unit or an opening and closing cover.

BACKGROUND

Conventionally, in an information processing apparatus, such as a printer or a multifunction machine, a maintenance operation, such as replacing an expendable item or trouble-shooting, is performed by opening an opening and closing unit or an opening and closing cover as an external part to expose and access the inside of the information processing apparatus. Further, an information processing apparatus of this kind is known in which a protective member is provided that protects a predetermined portion inside the information processing apparatus in conjunction with an opening and closing operation of an opening and closing unit or an opening and closing cover or the like (for example, see Patent Document 1).

RELATED ART

[Patent Doc. 1] JP Laid-Open Patent Application Publication 2007-65125

However, in the conventional information processing apparatus, when an unexpected external force is applied to the protective member due to an erroneous operation by an operator or the like, a phase shift may occur to the protective member, and thereafter, the protective member may not be able to normally operate.

The present invention is accomplished in view of the above problem, and intends to propose an information processing apparatus that can easily eliminate the situation in which a protective member cannot normally operate.

SUMMARY

An information processing apparatus disclosed in the application includes an apparatus main body, a rotating member that is provided rotatable with respect to the apparatus main body, a protective member that rotates along with rotation of the rotating member to protect a predetermined portion of the rotating member and that includes a first engagement part, and an interlocking part that interlocks the rotating member and the protective member and that includes a second engagement part that engages with the first engagement part of the protective member. The interlocking part causes the first engagement part and the second engagement part to be engaged with the protective member and the rotating member, and the interlocking part releases the engagement of the first engagement part and the second engagement part when the rotating member is in a predetermined rotation state.

In this way, in the present invention, when the rotating member is in a predetermined rotation state, the engagement between the first engagement part and the second engagement part is released. Thereby, even when a phase shift occurs to the protective member, the phase shift is reset by releasing the engagement between the first engagement part and the second engagement part. Thereafter, the first engagement part and the second engagement part can be re-engaged with each other in the state in which the phase shift has been reset. That is, in the present invention, by only rotating the rotating member, the phase shift of the protective member can be eliminated and the protective member can be returned to normal operation.

Thus, the present invention can realize an information processing apparatus that can easily eliminate the situation in which the protective member cannot normally operate.

BRIEF DESCRIPTIONS OF THE DRAWINGS

DETAILED DESCRIPTIONS OF PREFERRED EMBODIMENT(S)

In the following, a mode for carrying out the invention (hereinafter referred to as "embodiment") is described in detail with reference to the drawings.

1. First Embodiment

1-1. Configuration of Image Forming Apparatus

Figure 1:
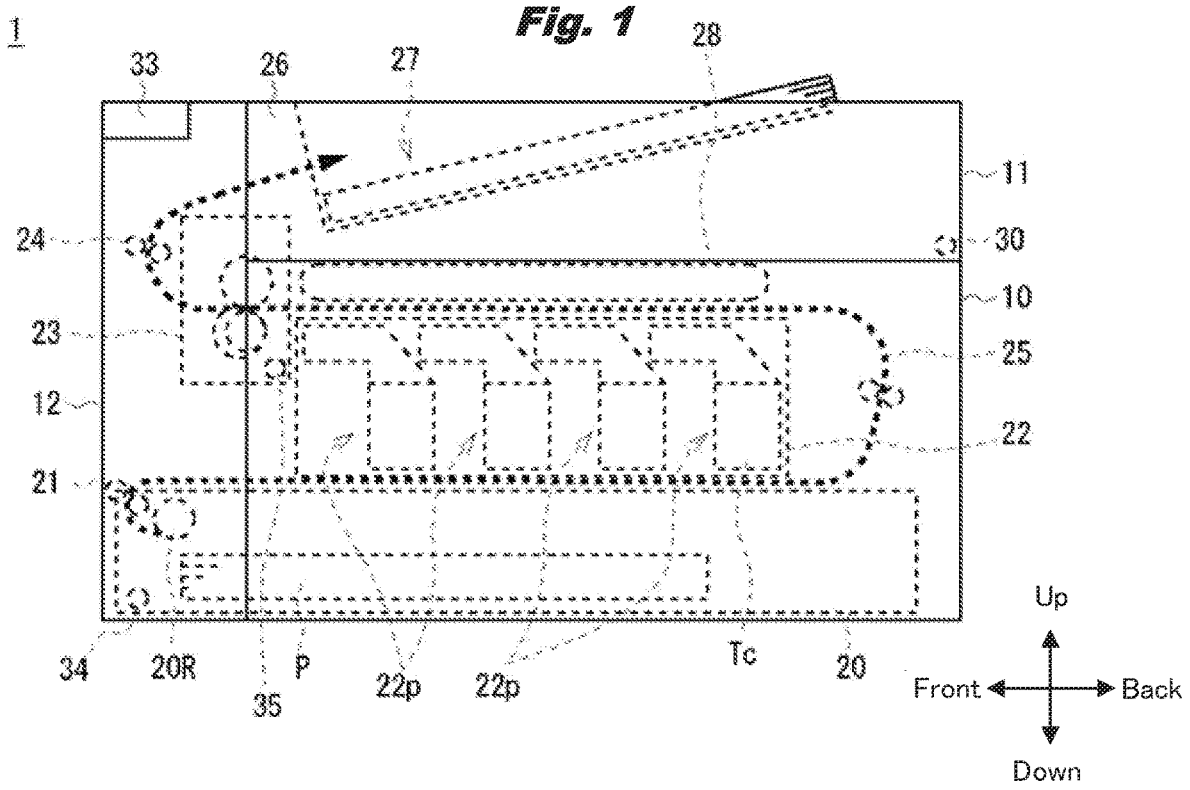
FIG. 1 is a side view illustrating a configuration of an image forming apparatus according to a first embodiment.

FIG. 1 illustrates an external configuration and an internal configuration of an image forming apparatus 1 of a first embodiment. FIG. 1 is a side view of the image forming apparatus 1, in which solid lines illustrate the external configuration and dotted lines illustrate the internal configuration. Further, the right side in FIG. 1 is the rear side of the image forming apparatus 1, and the left side in FIG. 1 is the front side of the image forming apparatus 1. As illustrated in FIG. 1, an external covering of the image forming apparatus 1 is formed by a box-shaped apparatus main body 10, a lid-like upper side opening and closing cover 11, which is provided on an upper side of the apparatus main body 10 and is openable and closeable in an up-down direction with respect to the apparatus main body 10, and a lid-like front side opening and closing cover 12, which is provided on a front side of the apparatus main body 10 and is openable and closeable in a front-rear direction with respect to the apparatus main body 10. FIG. 1 illustrates a closed state, in which the upper side opening and closing cover 11 and the front side opening and closing cover 12 are both closed with respect to the apparatus main body 10, and in which the inside of the image forming apparatus 1 is shielded by the upper side opening and closing cover 11 and the front side opening and closing cover 12.

The apparatus main body 10 includes a sheet feeding part 20, a first carrying roller pair 21, an image forming unit 22, a fuser unit 23, a second carrying roller pair 24, a carrying path 25, and the like. The sheet feeding part 20 is provided at a lower end inside the apparatus main body 10. The sheet feeding part 20 is provided with a sheet feeding roller 20R, and a stored sheet P is fed to the carrying path 25 by the sheet feeding roller 20R.

The carrying path 25 extends rearward from an upper portion of a front end of the sheet feeding part 20 and curves upward near a rear end inside the apparatus main body 10 to extend to near an upper end inside the apparatus main body 10, and then curves forward to extend to an upper portion of a front end inside the apparatus main body 10, and then is folded rearward therefrom and extends to a sheet ejection part 26 provided in the upper side opening and closing cover 11.

The first carrying roller pair 21 is provided on a carrying direction downstream side of the sheet feeding part 20, and, specifically, is arranged near the upper portion of the front end of the sheet feeding part 20 in the carrying path 25. The image forming unit 22 is provided on a carrying direction downstream side of the first carrying roller pair 21, and, specifically, is arranged on a lower side of a linear portion of the carrying path 25 extending in the front-rear direction near the upper end inside the apparatus main body 10. The image forming unit 22 has multiple (for example, four) image forming parts 22*p*. The multiple image forming parts 22*p* each have a toner cartridge Tc that contains a toner as a developer, a photosensitive drum (not illustrated in the drawings), and the like, and a toner image is formed on the photosensitive drum.

The fuser unit 23 is provided on a carrying direction downstream side of the image forming unit 22, and, specifically, is arranged near a front end of the image forming unit 22 in the carrying path 25. The second carrying roller pair 24 is provided on a carrying direction downstream side of the fuser unit 23, and, specifically, is arranged at a portion of the carrying path 25 that is folded rearward. The apparatus main body 10 is open at an upper surface thereof such that the image forming unit 22 and the fuser unit 23 are exposed.

The upper side opening and closing cover 11 includes the sheet ejection part 26, a sheet stacking part 27, a transfer belt 28, and the like. The sheet ejection part 26 is provided on a carrying direction downstream side of the second carrying roller pair 24, and, specifically, is arranged on a front end side on an inner side of the upper side opening and closing cover 11. The sheet ejection part 26 ejects the sheet P carried along the carrying path 25 to the sheet stacking part 27 provided on a carrying direction downstream side of the sheet ejection part 26. The transfer belt 28 is provided so as to protrude downward from a bottom surface of the upper side opening and closing cover 11, and, as illustrated in FIG. 1, is arranged at a position opposing the image forming unit 22 when the upper side opening and closing cover 11 is in the closed state.

A rear end part of the upper side opening and closing cover 11 is rotatably supported by a rotation shaft 30 which is positioned at an upper portion of the rear end of the apparatus main body 10 and is parallel to a left-right direction. As a result, the upper side opening and closing cover 11 can be opened and closed by rotating the upper side opening and closing cover 11 about the rotation shaft 30 such that a front end part of the upper side opening and closing cover 11 moves away from or approaches the apparatus main body 10. Then, when the upper side opening and closing cover 11 is in the closed state, the upper side opening and closing cover 11 covers the image forming unit 22 and the fuser unit 23 by covering the upper surface of the apparatus main body 10. When the upper side opening and closing cover 11 is in the open state (see FIG. 4) in which the upper side opening and closing cover 11 is opened with respect to the apparatus main body 10, the image forming unit 22 and the fuser unit 23 are exposed and can be accessed. The upper side opening and closing cover 11 is, for example, biased in an opening direction so as to be able to be easily opened. Although it is omitted in FIG. 1, the upper side opening and closing cover 11 includes a protective cover 31 (see FIGS. 2-4) that protects the transfer belt 28 when the upper side opening and closing cover 11 is in the open state, and an interlocking part 32 (see FIGS. 2-4) that interlocks the protective cover 31 with an opening and closing operation of the upper side opening and closing cover 11.

The front side opening and closing cover 12 is provided with an operation part 33 at an upper end part of the front side opening and closing cover 12 for performing an operation instruction to the image forming apparatus 1. A lower end part of the front side opening and closing cover 12 is rotatably supported by a rotation shaft 34, which is positioned at an lower portion of the front end of the apparatus main body 10 and extends in the left-right direction. As a result, the front side opening and closing cover 12 can be opened and closed by rotating the front side opening and closing cover 12 about the rotation shaft 34 such that an upper end part of the front side opening and closing cover 12 moves away from or approaches the apparatus main body 10. Then, when the front side opening and closing cover 12 is in the closed state, the front side opening and closing cover 12 covers the front end part of the apparatus main body 10 and the front end part of the upper side opening and closing cover 11 in the closed state. When the front side opening and closing cover 12 is in the open state (see FIG. 2), in which the front side opening and closing cover 12 is opened with respect to the apparatus main body 10, the front end part of the apparatus main body 10 and the front end part of the upper side opening and closing cover 11 are exposed and can be accessed. The upper side opening and closing cover 11 is configured such that the upper side opening and closing cover 11 can be opened only after the front side opening and closing cover 12 is opened, for example.

Further, the fuser unit 23 provided in the apparatus main body 10 is configured to rotate in conjunction with the opening and closing operation of the front side opening and closing cover 12. A lower end part of the fuser unit 23 is rotatably supported by a rotation shaft 35 that is provided in the apparatus main body 10 and extends in the left-right direction. When the front side opening and closing cover 12 is opened, accompanying this, an upper end part of the fuser unit 23 rotates about the rotation shaft 35 so as to fall to the front side (see FIG. 2). Further, the fuser unit 23 is configured such that, when the front side opening and closing cover 12 is closed, along with this, the upper end part that has fallen to the front side rotates about the rotation shaft 35 so as to rise toward the rear side.

Figure 3:
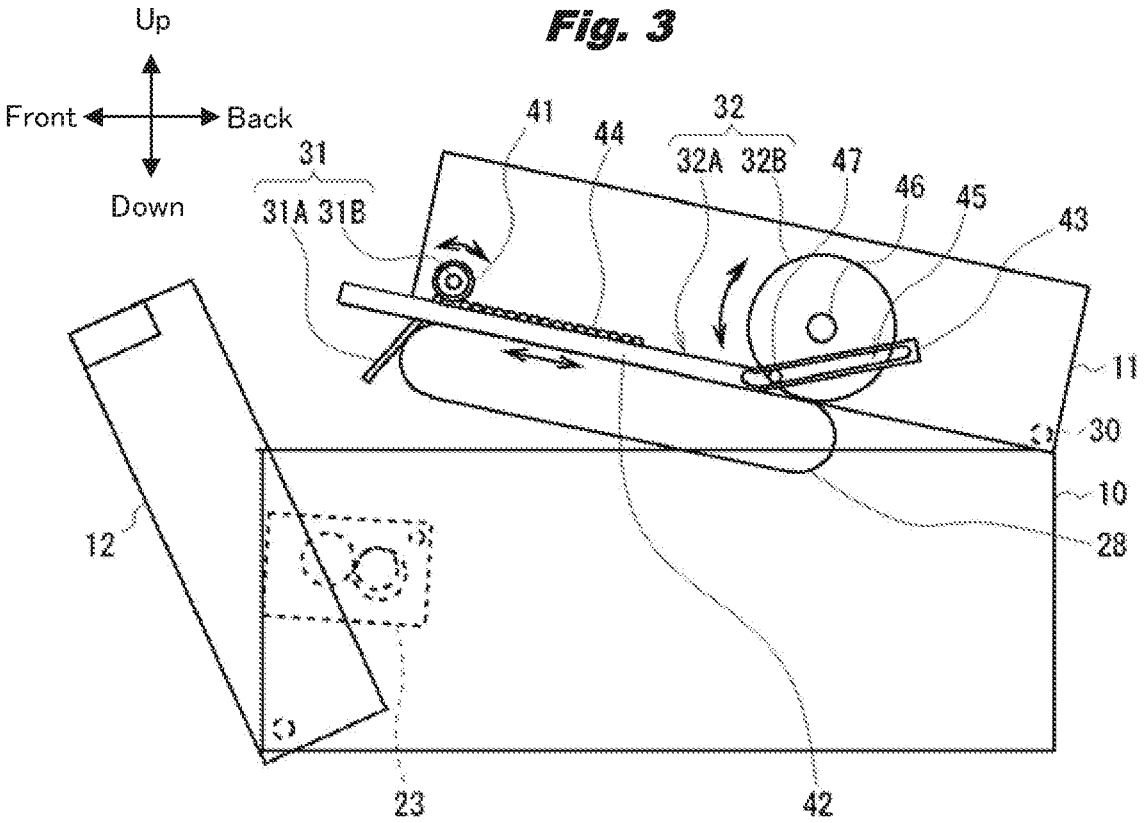
FIG. 3 is a side view illustrating the configuration of the image forming apparatus according to the first embodiment when the upper side opening and closing cover transitions from the closed state to an open state.
Figure 4:
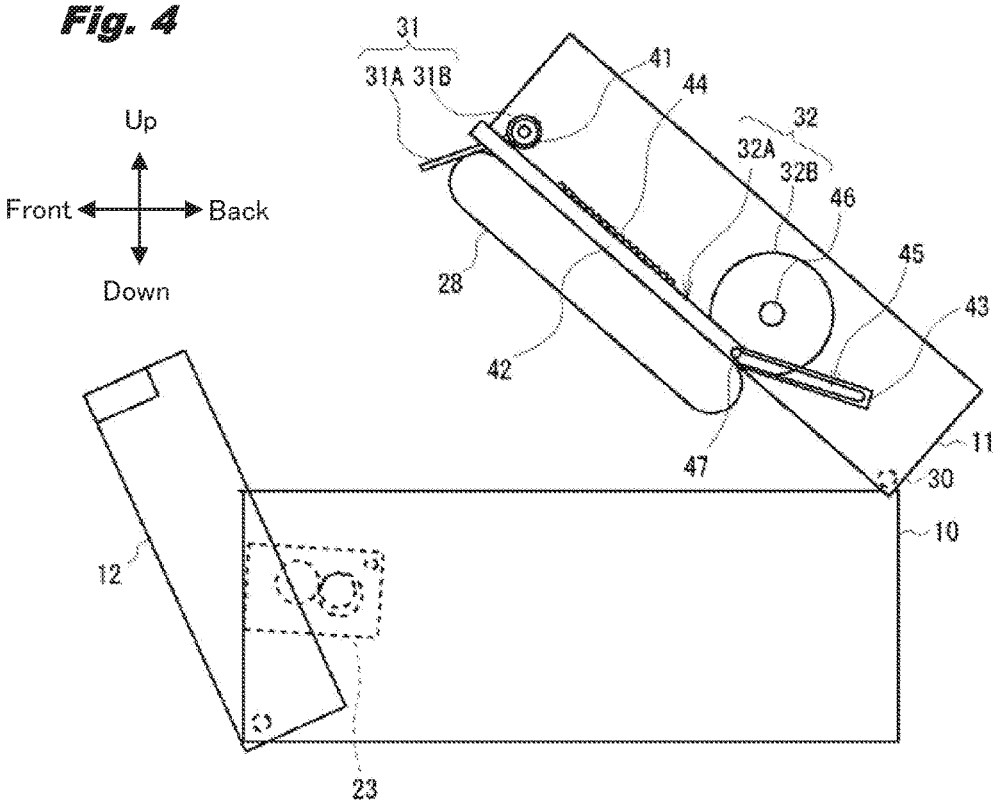
FIG. 4 is a side view illustrating the configuration of the image forming apparatus according to the first embodiment when the upper side opening and closing cover is in the open state.
Figure 5:
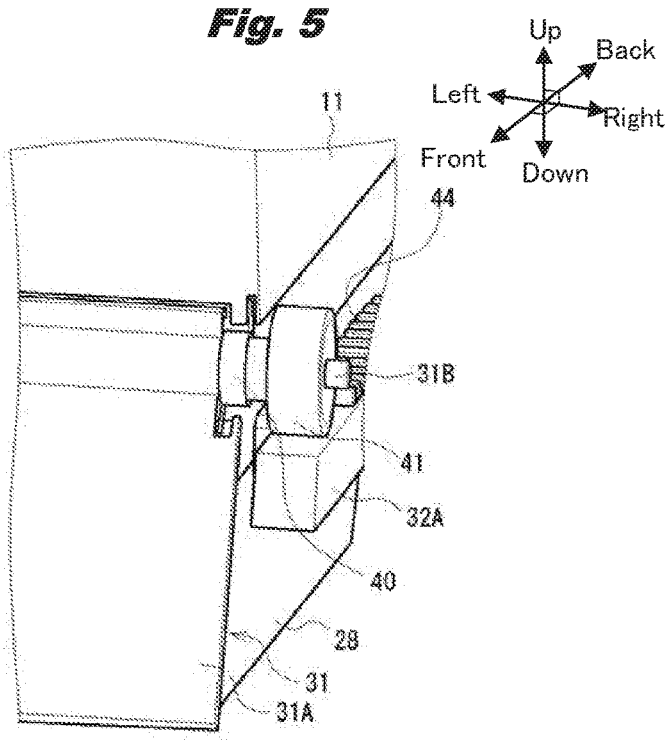
FIG. 5 is a perspective view illustrating a configuration of the upper side opening and closing cover according to the first embodiment in the open state.

Here, with reference to FIGS. 2-5, the protective cover 31 and the interlocking part 32, which are provided in the upper side opening and closing cover 11, are described in detail. Similar to FIG. 1, FIGS. 2-4 are side views of the image forming apparatus 1. However, in FIGS. 2-4, the sheet ejection part 26 and the sheet stacking part 27, which are provided in the upper side opening and closing cover 11, are omitted, and instead the protective cover 31 and the interlocking part 32 are illustrated. A portion of the protective cover 31 and a portion of the interlocking part 32 are provided inside the upper side opening and closing cover 11. However, in order to facilitate understanding of configurations thereof, the protective cover 31 and the interlocking part 32 are illustrated using solid lines in FIGS. 2-4. Further, in FIGS. 2-4, in order to facilitate understanding of the configurations, some of the transfer belt 28 and the like are deformed as compared to FIG. 1. FIG. 5 is a perspective view partially illustrating the protective cover 31 and the interlocking part 32 provided in the upper side opening and closing cover 11.

Figure 2:
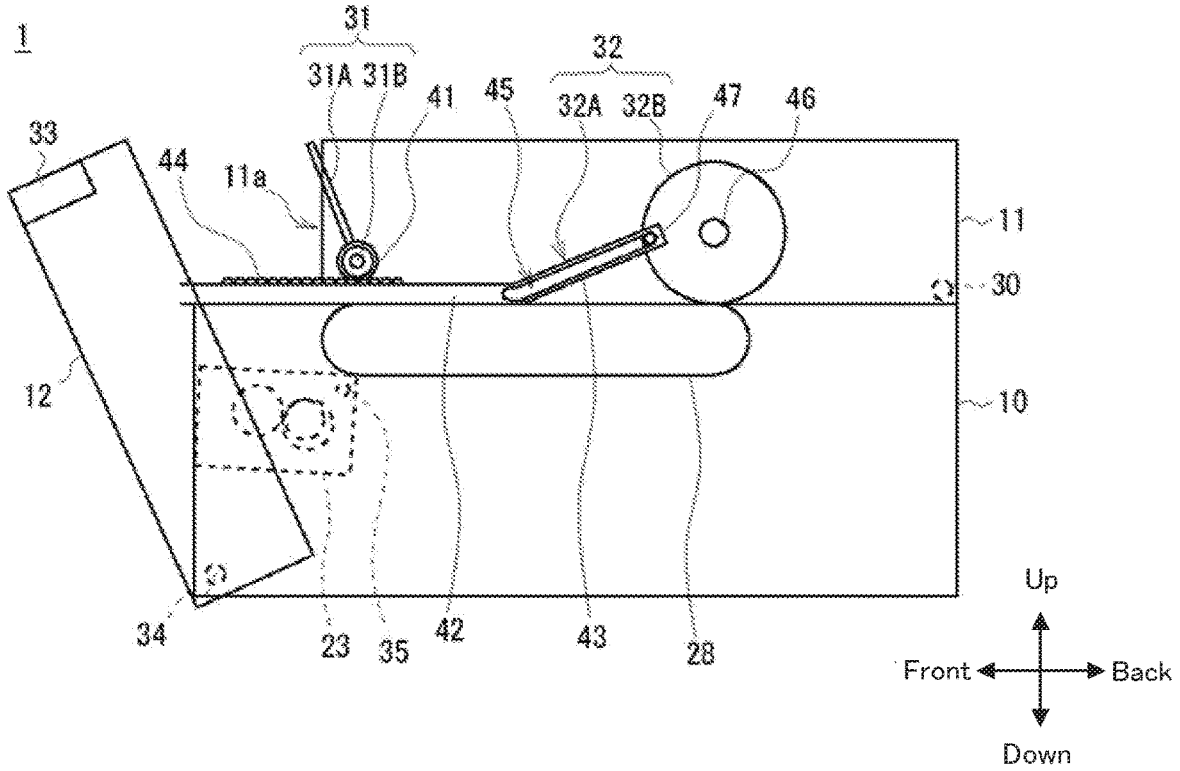
FIG. 2 is a side view illustrating the configuration of the image forming apparatus according to the first embodiment when an upper side opening and closing cover is in a closed state.

Further, FIG. 2 illustrates the image forming apparatus 1 when the upper side opening and closing cover 11 is in the closed state and the front side opening and closing cover 12 is in the open state. FIG. 3 illustrates the image forming apparatus 1 when the upper side opening and closing cover 11 is transitioning from the closed state to the open state or vice versa. FIG. 4 illustrates the image forming apparatus 1 when the upper side opening and closing cover 11 is in the open state.

The protective cover 31 is provided so as to cover a front opening part 11*a* (FIG. 2) of the upper side opening and closing cover 11 in the closed state, and includes a quadrangular plate-like member 31A that has a up-down direction length that is similar to the corresponding length of the front opening part 11 and a left-right direction length that is shorter as compared to the front opening part 11*a* of the upper side opening and closing cover 11, and a rotation shaft 31B that is provided on one side of the plate-like member 31A parallel to the left-right direction and extends in the left-right direction. Left and right end parts of the rotation shaft 31B are respectively rotatably supported on inner sides of left and right side surfaces of a lower portion of the front end of the upper side opening and closing cover 11 such that the protective cover 31 is rotatable about the rotation shaft 31B. However, the protective cover 31 may not rotate 360 degrees. The protective cover 31 is configured to rotate between a first rotation position (position in FIG. 2), at which a front end part (an end part on a far side from the rotation shaft 31B) of the protective cover 31 is in contact with or adjacent to a front upper end of the upper side opening and closing cover 11, and a second rotation position (position in FIG. 4), at which one side of the protective cover 31 is in contact with or adjacent to a front end of the transfer belt 28 which protrudes from the bottom surface of the upper side opening and closing cover 11. Further, the protective cover 31 is biased in a direction toward the second rotation position (that is, a direction approaching the transfer belt 28) by a torsion spring 40 illustrated in FIG. 5 or the like attached to the rotation shaft 31B. Further, the protective cover 31 is provided with a cylindrical pinion gear 41 at a position near one end (for example, the right end) of the rotation shaft 31B.

On the other hand, the interlocking part 32 has a link lever 32A and a link member 32B. The link lever 32A has a shape formed by bending a rectangular bar member into a chevron shape, and is configured by a first portion 42 that extends along the bottom surface of the upper side opening and closing cover 11 and a second portion 43 that extends obliquely upward and rearward from a rear end of the first portion 42.

The link lever 32A is provided on the inner side of one side surface (for example, the right side surface) in the left-right direction of the upper side opening and closing cover 11, and is slidably attached along the bottom surface of the upper side opening and closing cover 11 such that an upper surface of the first portion 42 passes under the pinion gear 41. Further, the first portion 42 of the link lever 32A a front end part 41*a*, a rear end part 42*b* and a center part 42*c*. A rack gear 44 that meshes (that is, engages) with the pinion gear 41 is formed on the center part 42*c*. That is, in the link lever 32A, a portion (the center part 42*c*) where the rack gear 44 is formed and portions (the front end part 42*a* and the rear end part 42*b*) where the rack gear 44 is not formed are provided adjacent to each other in a sliding direction. Further, the pinion gear 41 and the rack gear 44 are also parts of the interlocking part 32.

The link lever 32A is configured such that, as illustrated in FIG. 2, when the rack gear 44 of the center part is positioned on a lower side of the pinion gear 41, the pinion gear 41 and the rack gear 44 are engaged with each other, and, as illustrated in FIG. 4, when the front end part is positioned on the lower side of the pinion gear 41, the engagement between the pinion gear 41 and the rack gear 44 is released. Details will be described later. However, the pinion gear 41 and the rack gear 44 are configured such that, when the upper side opening and closing cover 11 is in the open state, the engagement of the pinion gear 41 and the rack gear 44 is released, and, when the engagement is released, the protective cover 31 protects the transfer belt 28 by being brought into contact with or adjacent to the transfer belt 28 and being held at the first rotation position due to the biasing force of the torsion spring 40. Further, in the link lever 32A, a hole (or groove) 45 is formed along the second portion 43 on a side surface of the second portion 43. The length of the hole 45 may be longer than an addition of a distance in which the first part 42 of the link lever 32A slides to cause the protective cover 31 to move from the position shown in FIG. 2 to the position shown in FIG. 3 and an area needed to release the engagement of the pinion gear 41 and the rack gear 44.

On the other hand, the link member 32B may be a disk-shaped member. A center part of the link member 32B is rotatably supported by a rotation shaft 46 which is positioned near a front-rear direction center of the upper side opening and closing cover 11 and is parallel to the left-right direction. A surface of a circular shape of the link member 32B is positioned adjacent to an inner side of the link lever 32A. The link member 32B is arranged such that a lower end of the link member 32B is aligned with a lower end of the link lever 32A and is configured to have a size such that a center of the link member 32B is positioned above the first portion 42 of the link lever 32A. Further, in the link member 32B, a column-shaped protruding part 47, which fits in the hole 45 of the link lever 32A, is provided at an outer peripheral part of a surface adjacent to the link lever 32A. That is, the link member 32B is linked to the link lever 32A by fitting the protruding part 47 into the hole 45 of the link lever 32A. Further, the link member 32B is configured to rotate in conjunction with the opening and closing operation of the upper side opening and closing cover 11 by a mechanism (not illustrated in the drawings).

That is, when the upper side opening and closing cover 11 rotates in the opening direction, the link member 32B rotates in a counterclockwise direction in FIG. 3 along with the rotation, and thereby slides the linked link lever 32A rearward. When the link lever 32A is slid rearward, the pinion gear 41 rotates in the counterclockwise direction in FIG. 3 while the pinion gear 41 and the rack gear 44 mesh with each other, and thereby, the protective cover 31 also rotates in the counterclockwise direction in FIG. 3.

Further, when the upper side opening and closing cover 11 rotates in a closing direction, the link member 32B rotates in a clockwise direction in FIG. 3 along with the rotation, and thereby slides the linked link lever 32A forward. When the link lever 32A is slid forward, the pinion gear 41 rotates in the clockwise direction in FIG. 3 while the pinion gear 41 and the rack gear 44 mesh with each other, and thereby, the protective cover 31 also rotates in the clockwise direction in FIG. 3.

In this way, the interlocking part 32, which includes the link lever 32A, the link member 32B, the pinion gear 41, and the rack gear 44, is configured to rotate the protective cover 31 in conjunction with the opening and closing operation of the upper side opening and closing cover 11. Here, an example is described in which the interlocking part 32 is provided on one end side (the right end side) of the rotation shaft 31B of the protective cover 31. However, it is also possible that an interlocking part 32 having a configuration that is left-right symmetric with respect to the one side is also provided on the other end side (the left end side) of the rotation shaft 31B of the protective cover 31, and the protective cover 31 is rotated by the left and right interlocking parts 32.

1-2. Operation of Image Forming Apparatus

Next, an operation of the image forming apparatus 1 is described. First, an operation when the image forming apparatus 1 forms (that is, prints) an image on a sheet P is described. When image data to be printed is received from a host device such as a PC (Personal Computer) connected by wired or wireless connection, the image forming apparatus 1 processes the received image data and starts to drive the parts to feed one by one the sheets P stored in the sheet feeding part 20 by the sheet feeding roller 20R.

The sheet P fed from the sheet feeding part 20 is carried along the carrying path 25 by the first carrying roller pair 21 and is carried to the image forming unit 22. The image forming unit 22 forms an electrostatic latent image on the photosensitive drum of each image forming part 22*p* and develops the electrostatic latent image with a toner to obtain a toner image. Then, the image forming unit 22 transfers the toner image formed on the photosensitive drum of each image forming part 22*p* onto the sheet P by the transfer belt 28. The sheet P, onto which the toner image is transferred, is carried to the fuser unit 23, and the toner image transferred onto the sheet P is fused on the sheet P by the fuser unit 23.

Thereafter, the sheet P is carried along the carrying path 25 by the second carrying roller pair 24, and is carried to the sheet ejection part 26, and is ejected to the sheet stacking part 27 by the sheet ejection part 26. The above is the operation when an image is formed on a sheet.

Next, an operation performed when the upper side opening and closing cover 11 of the image forming apparatus 1 is opened and closed during an maintenance operation or the like is described with reference to FIGS. 2-4. As illustrated in FIG. 2, before the upper side opening and closing cover 11 is opened, first, the front side opening and closing cover 12 is opened. In this case, the fuser unit 23 falls to the front side.

In FIG. 2, the upper side opening and closing cover 11 is still in the closed state. In this case, the protective cover 31 is in a state of being rotated to the first rotation position, that is, the position at which the front end part of the protective cover 31 is in contact with the front upper end of the upper side opening and closing cover 11. Further, in this way, when the upper side opening and closing cover 11 is in the closed state, by holding the link lever 32A at the position at which the pinion gear 41 on the protective cover 31 side and the rack gear 44 on the link lever 32A side engage with each other, the protective cover 31 is held at the first rotation position.

Here, when the upper side opening and closing cover 11 is rotated from the closed state illustrated in FIG. 2 in the opening direction as illustrated in FIG. 3, the link member 32B rotates in the counterclockwise direction in FIG. 3. In this case, the protruding part 47 of the link member 32B moves along the hole 45 of the link lever 32A and pulls the link lever 32A rearward, and thereby, the link lever 32A slides rearward.

When the link lever 32A slides rearward, the pinion gear 41 engaged with the rack gear 44 rotates in the counterclockwise direction in FIG. 3 along with the sliding of the link lever 32A, and thereby, the protective cover 31 rotates in the counterclockwise direction in FIG. 3 (that is, in the direction from the first rotation position toward the second rotation position).

Then, when the protective cover 31 rotates to the second rotation position, at which the protective cover 31 becomes in contact with the transfer belt 28 (or to a vicinity of the second rotation position), the front end part (a portion where the rack gear 44 is not formed) of the link lever 32A reaches the lower side of the pinion gear 41, and thereby, the engagement between the pinion gear 41 and the rack gear 44 is released. In this case, the protective cover 31 is held at the second rotation position by the biasing force of the torsion spring 40.

Thereafter, as illustrated in FIG. 4, until the upper side opening and closing cover 11 is further rotated to the open state, the engagement between the pinion gear 41 and the rack gear 44 remains released, and the protective cover 31 continues to be held at the second rotation position. In this way, the image forming apparatus 1 is configured such that, when the upper side opening and closing cover 11 is in the open state, the engagement between the pinion gear 41 and the rack gear 44 is released and the protective cover 31 is held at the second rotation position, and thereby, the transfer belt 28 is protected by the protective cover 31. As a result, an operator who performs a maintenance operation, for example, can access the inside of the apparatus main body 10 of the image forming apparatus 1 without scratching the transfer belt 28 and can perform the maintenance operation such as replacement of an expendable item or troubleshooting, or the like.

After the maintenance operation is completed, when the upper side opening and closing cover 11 is rotated in the closing direction from the open state illustrated in FIG. 4, the link member 32B rotates in the clockwise direction in FIG. 3 and the link lever 32A slides forward. Then, again as illustrated in FIG. 3, when the link lever 32A slides until the rack gear 44 formed at the center part of the link lever 32A reaches the lower side of the pinion gear 41, the pinion gear 41 and the rack gear 44 are again engaged with each other in the state in which the protective cover 31 is positioned at the second rotation position.

Thereafter, when the upper side opening and closing cover 11 is further rotated and the link lever 32A slides forward, the pinion gear 41 engaged with the rack gear 44 rotates in the clockwise direction in FIG. 3 along with the rotation, and thereby, the protective cover 31 rotates in the clockwise direction in FIG. 3 (that is, in the direction from the second rotation position toward the first rotation position).

Then, when the upper side opening and closing cover 11 is rotated to the closed state illustrated in FIG. 2, the protective cover 31 is again rotated to the first rotation position. At this time, the protective cover 31 is held at the first rotation position due to the engagement between the pinion gear 41 and the rack gear 44.

In this way, in the image forming apparatus 1, when the upper side opening and closing cover 11 is caused to transition from the closed state to the open state, the protective cover 31 is rotated from the first rotation position to the second rotation position due to the engagement between the pinion gear 41 and the rack gear 44 along with the transition, and thereafter, the engagement between the pinion gear 41 and the rack gear 44 is released. Then, when the upper side opening and closing cover 11 is caused to transition from the open state to the closed state, along with this, the pinion gear 41 and the rack gear 44 are again caused to engage with each other, and the protective cover 31 is rotated from the second rotation position to the first rotation position. The above is the operation performed when the upper side opening and closing cover 11 is opened and closed.

1-3. Summary and Effect

As described above, the image forming apparatus 1 of the first embodiment is configured such that, when the upper side opening and closing cover 11 is rotated from the closed state to the open state, the protective cover 31 is rotated from the first rotation position to the second rotation position along with the rotation due to the engagement between the pinion gear 41 and the rack gear 44 of the interlocking part 32, and thereafter, the engagement between the pinion gear 41 and the rack gear 44 is released. Further, the image forming apparatus 1 is configured such that, when the upper side opening and closing cover 11 is rotated from the open state to the closed state, the pinion gear 41 and the rack gear 44 are again caused to engage with each other in the state in which the protective cover 31 is held at the second rotation position along with the rotation, and the protective cover 31 is rotated from the second rotation position to the first rotation position.

However, in the image forming apparatus 1, for example, when an unexpected external force is applied to the protective cover 31 while the upper side opening and closing cover 11 is being opened, phases (that is, meshing positions) of the pinion gear 41 and the rack gear 44 of the interlocking part 32 may be shifted. Then, when the upper side opening and closing cover 11 is closed with the phases shifted, the protective cover 31 is displaced from the first rotation position which is the normal position, and cannot normally rotate.

Therefore, in the image forming apparatus 1 of the present embodiment, when the upper side opening and closing cover 11 is rotated from the closed state to the open state, the engagement between the pinion gear 41 and the rack gear 44 is temporarily released. By doing so, in the image forming apparatus 1, even when the phases of the pinion gear 41 and the rack gear 44 are shifted, by opening the upper side opening and closing cover 11 to the open state, the phase shift between the pinion gear 41 and the rack gear 44 can be reset.

Further, in the image forming apparatus 1, when the upper side opening and closing cover 11 is rotated from the open state to the closed state, the pinion gear 41 and the rack gear 44 are again engaged with each other in the state in which the protective cover 31 is positioned at the second rotation position which is a reference position (that is, a normal rotation position at the time when the rotation of the protective cover 31 is started).

As a result, in the image forming apparatus 1, the rotation of the protective cover 31 can be started from the reference position after the phase shift between the pinion gear 41 and the rack gear 44 is reset, and thus, the protective cover 31 can be returned to the normal operation. That is, in the image forming apparatus 1, even when a phase shift between the pinion gear 41 and the rack gear 44 occurs, the operation of the protective cover 31 can be returned to the normal operation in which the protective cover 31 rotates between the first rotation position and the second rotation position in conjunction with the opening and closing operation of the upper side opening and closing cover 11, and thus, a situation in which the protective cover 31 cannot normally operate can be eliminated.

Further, in the image forming apparatus 1, the protective cover 31 can be returned to the normal operation by opening and closing the upper side opening and closing cover 11. Therefore, the protective cover 31 can be easily returned to the normal operation without performing troublesome operation such as correcting the phase shift between the pinion gear 41 and the rack gear 44 by disassembling the upper side opening and closing cover 11.

2. Second Embodiment

Next, a second embodiment is described. The second embodiment is an embodiment in which a stopper 50 (see FIGS. 6A-6C) limiting the rotation of the protective cover 31 when the upper side opening and closing cover 11 is in the open state is added to the upper side opening and closing cover 11. Therefore, here, only the stopper 50, and the protective cover 31 and the link lever 32A that are related to an operation of the stopper 50, are described with reference to FIGS. 6A-6C and 7, and description about the other parts is omitted.

2-1. Configuration of Stopper

Figure 6A:
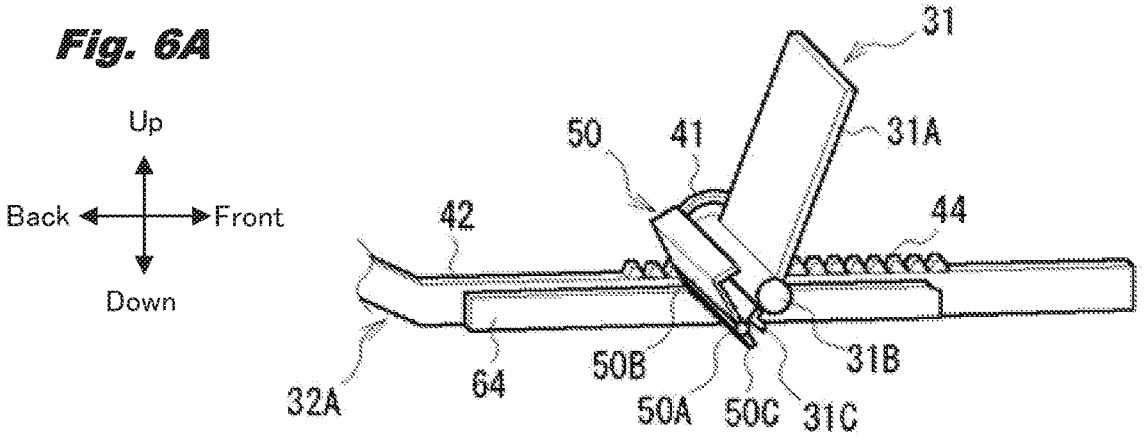
FIGS. 6A-6C are perspective views illustrating a configuration and an operation of a stopper according to a second embodiment.
Figure 6B:
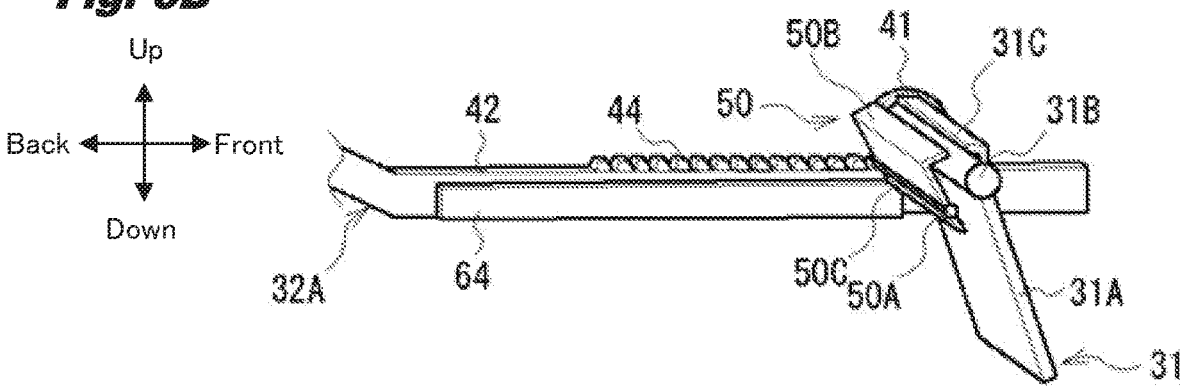
Figure 6C:
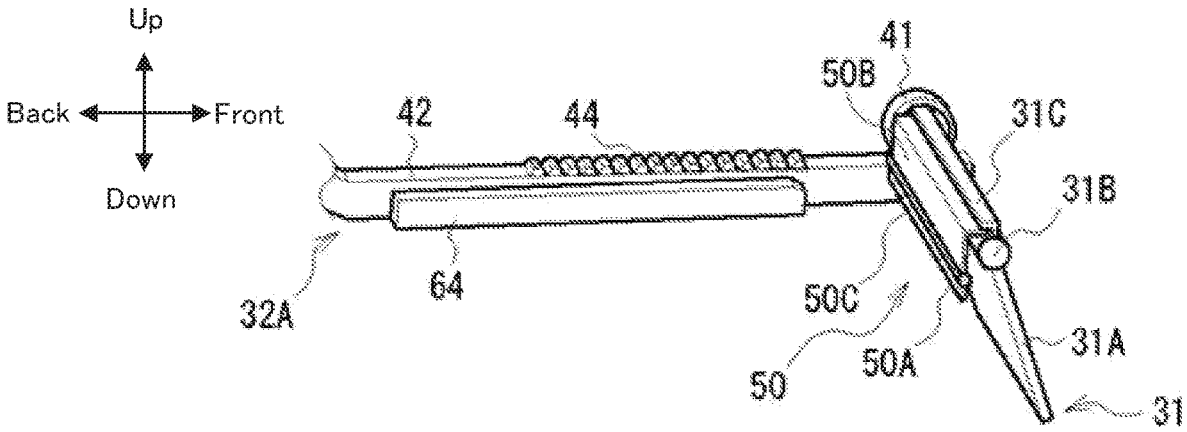
Figure 7:
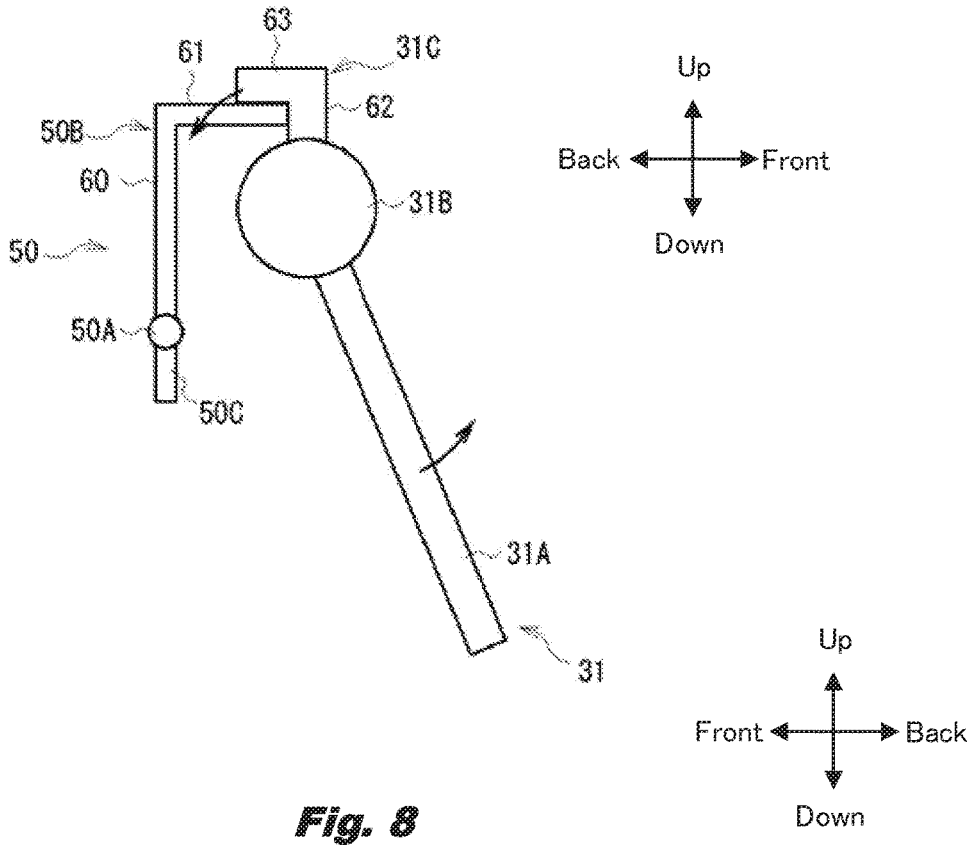
FIG. 7 is a side view illustrating the stopper according to the second embodiment when the stopper is engaged with a protective cover.

FIGS. 6A-6C and 7 illustrate external configurations of the stopper 50, the protective cover 31 and the link lever 32A. FIGS. 6A-6C are perspective views of the stopper 50, the protective cover 31 and the link lever 32A, which are partially deformed in order to facilitate understanding the configurations. Further, FIG. 7 is a side view of the stopper 50 and the protective cover 31. Further, FIG. 6A illustrates a case when the protective cover 31 is at the first rotation position (that is, when the upper side opening and closing cover 11 is in the closed state); FIG. 6B illustrates a case when the protective cover 31 is near the second rotation position; and FIGS. 6C and 7 illustrate a case when the protective cover 31 is at the second rotation position (that is, when the upper side opening and closing cover 11 is in the open state).

The stopper 50 is provided in a vicinity behind the protective cover 31 and on an inner side of the link lever 32A. The stopper 50 includes a rotation shaft 50A that extends in the left-right direction parallel to the rotation shaft 31B of the protective cover 31, a protective cover engagement part 50B that engages with the protective cover 31, and a link lever engagement part 50C that engages with the link lever 32A, the protective cover engagement part 50B and the link lever engagement part 50C being provided on an outer peripheral surface of the rotation shaft 50A.

The rotation shaft 50A of the stopper 50 is provided behind and below the rotation shaft 31B of the protective cover 31, and is rotatably supported by the upper side opening and closing cover 11. As a result, the stopper 50 is rotatable about the rotation shaft 50A. As illustrated in FIG. 7, the protective cover engagement part 50B includes a plate-like base part 60 that vertically extends from the outer peripheral surface of the rotation shaft 50A, and a plate-like front end part 61 that extends from a front end of the base part 60 in a direction perpendicular to the base part 60 and toward the protective cover 31 side. The plate-like base part 60 as a whole has a plate-like shape having an L-shaped cross section. The link lever engagement part 50C is provided on an opposite side with respect to the protective cover engagement part 50B with the rotation shaft 50A sandwiched therebetween, and has a plate-like shape that extends vertically from the outer peripheral surface of the rotation shaft 50A. The stopper 50 is biased by a torsion spring (not illustrated in FIG. 7) in a direction (clockwise direction in FIG. 7) in which the protective cover engagement part 50B approaches the protective cover 31.

On the other hand, a stopper engagement part 31C that engages with the stopper 50 is added to the protective cover 31 on an opposite side with respect to the plate-like member 31A with the rotation shaft 31B sandwiched therebetween. As illustrated in FIG. 7, the stopper engagement part 31C includes a plate-like base part 62 that vertically extends from an outer peripheral surface of the rotation shaft 31B, and a plate-like front end part 63 that extends from a front end of the base part 62 in a direction perpendicular to the base part 62 and toward the stopper 50 side. the stopper engagement part 31C as a whole has a plate-like shape having an L-shaped cross section.

As illustrated in FIGS. 6C and 7, positions and sizes of the stopper 50 and the protective cover 31 are selected such that, when the protective cover 31 is at the second rotation position (the position when the upper side opening and closing cover 11 is in the open state), the protective cover engagement part 50B of the stopper 50 and the stopper engagement part 31C of the protective cover 31 engage with each other. Specifically, when the protective cover 31 is at the second rotation position, as illustrated in FIG. 7, the front end part 61 of the protective cover engagement part 50B on the stopper 50 side enters a corner of the front end part 63 and the base part 62 of the stopper engagement part 31C on the protective cover 31 side, and the front end part 61 of the protective cover engagement part 50B is in contact with the base part 62 of the stopper engagement part 31C. To allow the front end part 61 of the protective cover engagement part 50B to enter the corner of the front end part 62, the front end part 63 should be shorter than the front end part 61.

Further, as illustrated in FIGS. 6A-6C, a stopper engagement part 64 that engages with the stopper 50 is added to the link lever 32A on a side surface on an inner side of the first portion 42 that has the rack gear 44. The stopper engagement part 64 has a plate-like shape extending in the front-rear direction with respect to the apparatus. An upper surface of the stopper engagement part 64 is parallel to the upper surface of the first portion 42 and is slightly lower than the upper surface of the first portion 42. The stopper engagement part 64 extends from a vicinity of a rear end of the first portion 42 to a vicinity of a front end of the rack gear 44.

Positions and sizes of the stopper 50 and the link lever 32A are selected such that, as illustrated in FIG. 6A, when the pinion gear 41 and the rack gear 44 engage with each other (that is, when the upper side opening and closing cover 11 is in the closed state), the link lever engagement part 50C of the stopper 50 and the stopper engagement part 64 of the link lever 32A engage with each other, and, as illustrated in FIG. 6C, when the engagement between the pinion gear 41 and the rack gear 44 is released (that is, when the upper side opening and closing cover 11 is in the open state), the engagement between the link lever engagement part 50C of the stopper 50 and the stopper engagement part 64 of the link lever 32A is released. Specifically, when the pinion gear 41 and the rack gear 44 engage with each other, a lower end of the link lever engagement part 50C on the stopper 50 side is in contact with the upper surface of the stopper engagement part 64 on the link lever 32A side, and thereby, the link lever 32A holds the protective cover 31 at a rotation position at which the engagement with the stopper 50 is released. Further, when the engagement between the pinion gear 41 and the rack gear 44 is released, the lower end of the link lever engagement part 50C is away from the upper surface of the stopper engagement part 64, and thereby, the protective cover 31 rotates to engage with the stopper 50.

2-2. Operation of Stopper

Next, an operation of the stopper 50 when the upper side opening and closing cover 11 is opened and closed is described with reference to FIGS. 6A-6C and 7. As illustrated in FIG. 6A, the upper side opening and closing cover 11 (omitted in FIGS. 6A-6C and 7) is in the closed state. When the protective cover 31 is at the first rotation position, the pinion gear 41 and the rack gear 44 are in a state of engaging with each other. The stopper 50 is engaged with the link lever 32A, but is not engaged with the protective cover 31. Therefore, at this point, the stopper 50 does not limit the rotation of the protective cover 31.

Thereafter, as illustrated in FIG. 6B, when the upper side opening and closing cover 11 is opened, along with this, the link lever 32A slides rearward and the protective cover 31 rotates in the direction toward the second rotation position. Also in this case, the stopper 50 is not engaged with the protective cover 31. Therefore, also in this case, the stopper 50 does not limit the rotation of the protective cover 31.

Thereafter, as illustrated in FIG. 6C, when the upper side opening and closing cover 11 is further opened to the open state, in this case, the protective cover 31 reaches the second rotation position. At this point, the engagement between the pinion gear 41 and the rack gear 44 is released, and the engagement between the stopper 50 and the link lever 32A is also released. Further, at this point, the stopper 50 rotates in the clockwise direction in the drawing (that is, in the direction to engage the protective cover 31), and limits the rotation of the protective cover 31 by engaging with the protective cover 31 at the second rotation position.

In fact, as illustrated in FIG. 7, when the stopper 50 and the protective cover 31 engage with each other, the rotation shaft 50A of the stopper 50 is positioned on a lower side of the rotation shaft 31B of the protective cover 31, and the front end part 61 of the protective cover engagement part 50B of the stopper 50 is positioned on a lower side of the front end part 63 of the stopper engagement part 31C of the protective cover 31. In this state, even when an attempt is made to rotate the protective cover 31 which is engaged with the stopper 50 in the counterclockwise direction in the drawing, for example, the front end part 63 of the stopper engagement part 31C is in contact with the front end part 61 of the protective cover engagement part 50B, and cannot be further rotated. Further, in this case, the protective cover 31 is in contact with the transfer belt 28 (omitted in the drawing), and thus, cannot rotate in the clockwise direction in the drawing. Therefore, the protective cover 31 is in a state in which the rotation of the protective cover 31 is limited (that is, a state in which the rotation position is fixed) at this time.

Thereafter, when the upper side opening and closing cover 11 closes, as illustrated in FIG. 6B, the pinion gear 41 and the rack gear 44 are reengaged with each other, the stopper 50 and the link lever 32A are reengaged with each other, and the stopper 50 rotates in the counterclockwise direction in the drawing (that is, in a direction opposite to the direction of engaging with the protective cover 31), and thereby, the engagement between the stopper 50 and the protective cover 31 is released.

In this way, the stopper 50 limits the rotation of the protective cover 31 by engaging with the protective cover 31 when the protective cover 31 is at the second rotation position. The above is the operation of the stopper 50 when the upper side opening and closing cover 11 is opened and closed.

2-3. Summary and Effect

As described above, the image forming apparatus 1 of the second embodiment is configured such that, when the upper side opening and closing cover 11 is in the open state (that is, when the engagement between the pinion gear 41 and the rack gear 44 is released), the stopper 50 engages with the protective cover 31 that is at the second rotation position and is in contact with the transfer belt 28, and thereby limits the rotation of the protective cover 31.

In the above-described first embodiment, when the upper side opening and closing cover 11 is opened, along with this, the engagement between the pinion gear 41 and the rack gear 44 is released and a phase shift between the pinion gear 41 and the rack gear 44 is reset. Thereafter, along with the upper side opening and closing cover 11 to close, the pinion gear 41 and the rack gear 44 are re-engaged with each other, and thereby, the protective cover 31 is returned to the normal operation.

However, when closing the upper side opening and closing cover 11, if an external force is applied to the protective cover 31 which is biased toward the transfer belt 28 side before the pinion gear 41 and the rack gear 44 are re-engaged with each other and if the pinion gear 41 and the rack gear 44 are re-engaged with each other while the protective cover 31 is rotated in the direction away from the transfer belt 28, the upper side opening and closing cover 11 is closed with the phases of the pinion gear 41 and the rack gear 44 being shifted. Thus, the protective cover 31 cannot be returned to the normal operation.

Therefore, in the image forming apparatus 1 of the second embodiment, the stopper 50 releases the engagement between the pinion gear 41 and the rack gear 44 and fixes the protective cover 31 at the second rotation position. By doing so, in the image forming apparatus 1, it is possible to avoid a situation where the pinion gear 41 and the rack gear 44 are re-engaged with each other in a state where the protective cover 31 is displaced from the second rotation position which is the reference position. Thus, in the image forming apparatus 1 of the second embodiment, when the upper side opening and closing cover 11 closes, the pinion gear 41 and the rack gear 44 can be re-engaged with each other in a state in which the phases are surely reset. Therefore, as compared to the first embodiment, the protective cover 31 can be more reliably returned to the normal operation.

3. Third Embodiment

Next, a third embodiment is described. In the above-described first embodiment, when the upper side opening and closing cover 11 is in the closed state, the pinion gear 41 and the rack gear 44 are engaged (that is, meshed) with each other. When the upper side opening and closing cover 11 is in the open state, the engagement between the pinion gear 41 and the rack gear 44 is released. However, contrary to the first embodiment, in the third embodiment, when the upper side opening and closing cover 11 is in the open state, the pinion gear 41 and the rack gear 44 are engaged with each other, and, when the upper side opening and closing cover 11 is in the closed state, the engagement between the pinion gear 41 and the rack gear 44 is released. Therefore, with reference to FIGS. 8-11, which correspond to FIGS. 2-5, only a protective cover 31 and an interlocking part 70 which are provided in the upper side opening and closing cover 11 are described, and description about other parts is omitted.

3-1. Configuration of Upper Side Opening and Closing Cover

FIGS. 8-11 illustrate configurations of the protective cover 31 and the interlocking part 70 provided in the upper side opening and closing cover 11 of an image forming apparatus 100 of the third embodiment. The protective cover 31 has the same configuration as the protective cover 31 of the first embodiment. However, contrary to the first embodiment, due to a torsion spring 101 illustrated in FIG. 11, the protective cover 31 is biased in a direction toward the first rotation position (that is, in a direction approaching the front upper end of the upper side opening and closing cover 11). The interlocking part 70 is different from the interlocking part 32 of the first embodiment in that the position of the rack gear 44 of the link lever 32A is different. The rest of the configuration is similar. That is, in the interlocking part 70, the rack gear 44 is formed in the front end part, not in the center part, of the first portion 42 of the link lever 32A.

In this way, the link lever 32A is configured such that, by forming the rack gear 44 in the front end part, when the upper side opening and closing cover 11 is in the closed state (the case of FIG. 8), the center part is positioned on the lower side of the pinion gear 41, and thereby, the engagement between the pinion gear 41 and the rack gear 44 is released. In addition, when the upper side opening and closing cover 11 is in the open state (the case of FIG. 10), the rack gear 44 positioned at the front end part is positioned on the lower side of the pinion gear 41, and thereby, the pinion gear 41 and the rack gear 44 are engaged with each other.

3-2. Opening and Closing Operation of Upper Side Opening and Closing Cover

Figure 8:
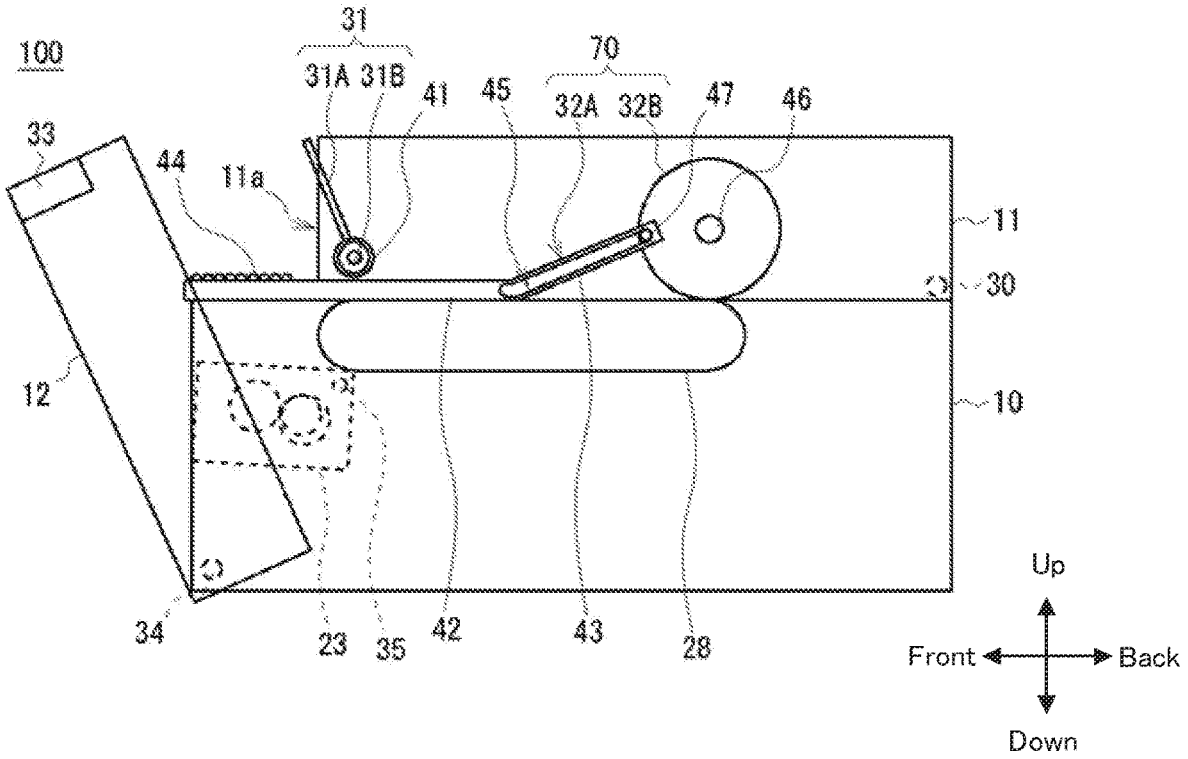
FIG. 8 is a side view illustrating a configuration of an image forming apparatus according to a third embodiment when an upper side opening and closing cover is in a closed state.

Next, an operation performed when the upper side opening and closing cover 11 of the image forming apparatus 100 is opened and closed is described with reference to FIGS. 8-10. As illustrated in FIG. 8, when the upper side opening and closing cover 11 is in the closed state, the engagement between the pinion gear 41 on the protective cover 31 side and the rack gear 44 on the link lever 32A side is released. In this case, due to the biasing force of the torsion spring 101, the protective cover 31 is in contact with the front upper end of the upper side opening and closing cover 11 and is held at the first rotation position.

Figure 9:
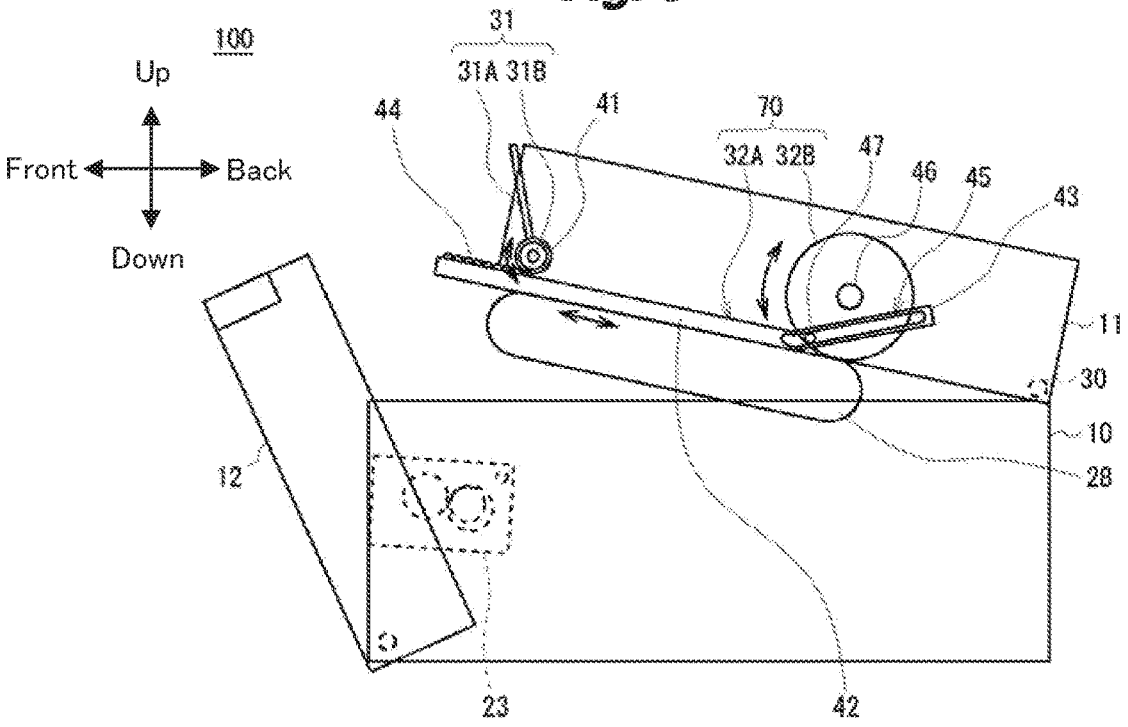
FIG. 9 is a side view illustrating the configuration of the image forming apparatus according to the third embodiment when the upper side opening and closing cover transitions from the closed state to an open state.

Here, when the upper side opening and closing cover 11 is rotated from the closed state illustrated in FIG. 8 in the opening direction, as illustrated in FIG. 9, the link member 32B rotates in the counterclockwise direction in FIG. 9, and the link lever 32A slides rearward along with the rotation. Then, when the rack gear 44 positioned at the front end part of the link lever 32A reaches the lower side of the pinion gear 41, the pinion gear 41 and the rack gear 44 engage with each other in the state in which the protective cover 31 is positioned at the first rotation position.

Thereafter, when the upper side opening and closing cover 11 is further rotated and the link lever 32A slides rearward, the pinion gear 41 engaged with the rack gear 44 rotates in the counterclockwise direction in FIG. 9 along with the rotation and the sliding, and thereby, the protective cover 31 rotates in the counterclockwise direction in FIG. 9 (that is, in the direction from the first rotation position toward the second rotation position).

Figure 10:
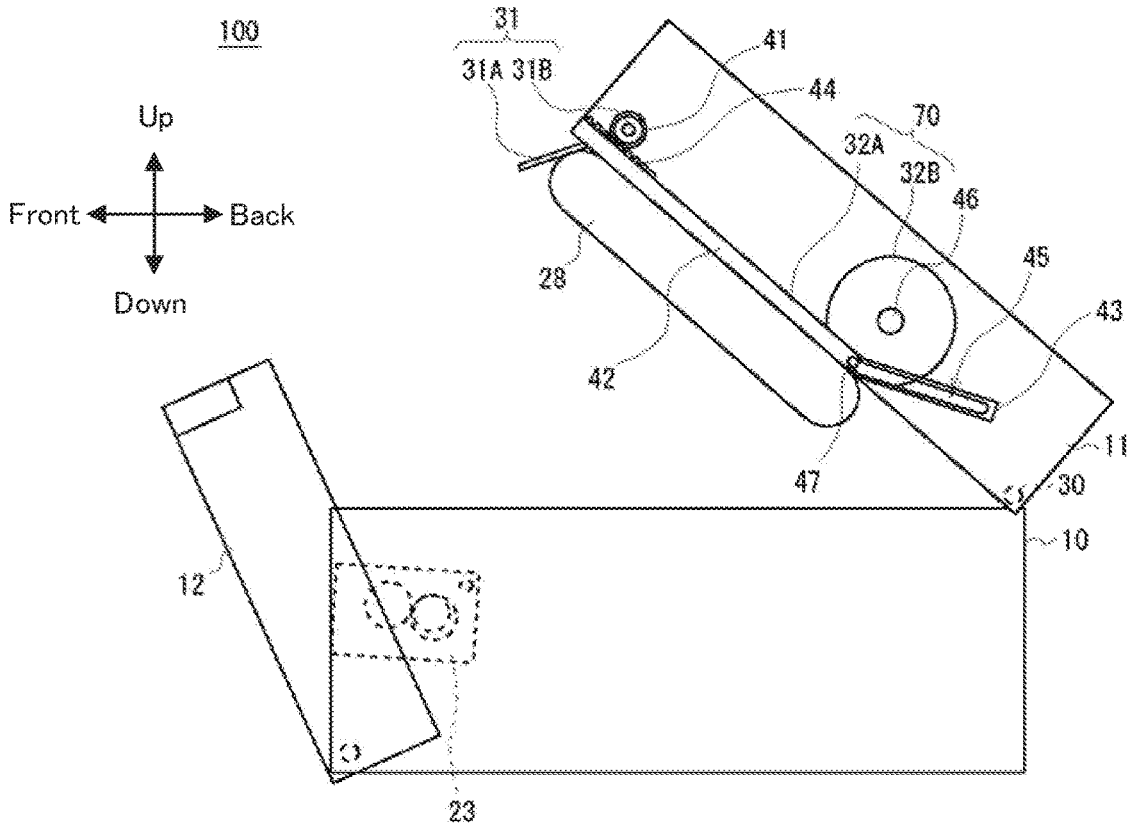
FIG. 10 is a side view illustrating the configuration of the image forming apparatus according to the third embodiment when the upper side opening and closing cover is in the open state.
Figure 11:
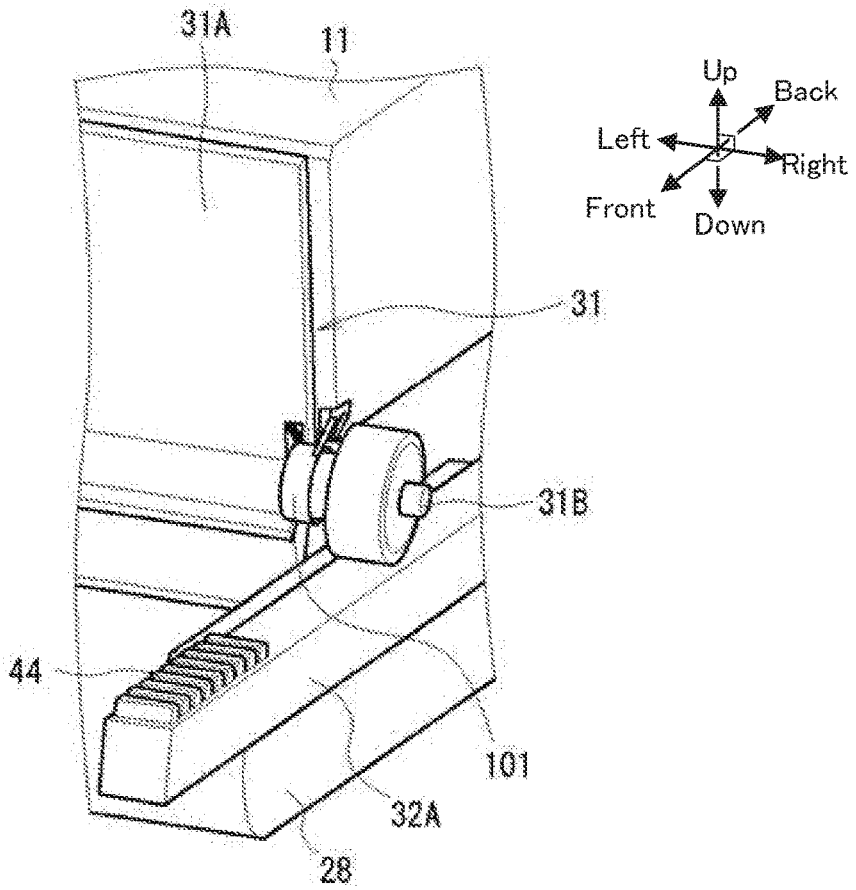
FIG. 11 is a perspective view illustrating a configuration of the upper side opening and closing cover according to the third embodiment in the open state.

Then, when the upper side opening and closing cover 11 is rotated to the open state illustrated in FIG. 10, in this case, the protective cover 31 is rotated to the second rotation position. In this case, the protective cover 31 is held at the second rotation position due to the engagement between the pinion gear 41 and the rack gear 44. In this case, the protective cover 31 protects the transfer belt 28.

Thereafter, when the upper side opening and closing cover 11 is rotated in the closing direction from the open state illustrated in FIG. 10, the link member 32B rotates in the clockwise direction in FIG. 9 and the link lever 32A slides forward. Then, as illustrated in FIG. 9, when the protective cover 31 is rotated to the first rotation position, the center part of the link lever 32A (the portion where the rack gear 44 is not formed) reaches the lower side of the pinion gear 41, and thereby, in this case, the engagement between the pinion gear 41 and the rack gear 44 is released. In this case, the protective cover 31 is held at the first rotation position by the biasing force of the torsion spring 101.

In this way, in the image forming apparatus 100 of the third embodiment, when the upper side opening and closing cover 11 transitions from the closed state to the open state, the pinion gear 41 and the rack gear 44, which have been disengaged from each other, are engaged with each other along with the transition, and the protective cover 31 is rotated from the first rotation position to the second rotation position. Then, when the upper side opening and closing cover 11 is caused to transition from the open state to the closed state, the protective cover 31 is rotated from the second rotation position to the first rotation position along with the transition due to the engagement between the pinion gear 41 and the rack gear 44, and thereafter, the engagement between the pinion gear 41 and the rack gear 44 is again released. The above is the operation performed when the upper side opening and closing cover 11 is opened and closed.

3-3. Summary and Effect

As described above, in the image forming apparatus 100 of the third embodiment, when the upper side opening and closing cover 11 is rotated from the closed state to the open state, the pinion gear 41 and the rack gear 44, which have been disengaged from each other, are engaged with each other along with the rotation, and the protective cover 31 is rotated from the first rotation position to the second rotation position. Further, in the image forming apparatus 100, when the upper side opening and closing cover 11 is rotated from the open state to the closed state, due to the engagement between the pinion gear 41 and the rack gear 44, the protective cover 31 is rotated to the first rotation position along with the rotation of the upper side opening and closing cover 11 due to the engagement between the pinion gear 41 and the rack gear 44, and thereafter, the engagement between the pinion gear 41 and the rack gear 44 is again released.

That is, in the image forming apparatus 100, when the upper side opening and closing cover 11 is rotated from the open state to the closed state, the engagement between the pinion gear 41 and the rack gear 44 is temporarily released. By doing so, in the image forming apparatus 100, even when the phases of the pinion gear 41 and the rack gear 44 are shifted, the phase shift between the pinion gear 41 and the rack gear 44 can be reset by opening and then closing the upper side opening and closing cover 11.

Further, in the image forming apparatus 100, when the upper side opening and closing cover 11 is rotated from the closed state to the open state, the pinion gear 41 and the rack gear 44 are again engaged with each other in the state in which the protective cover 31 is positioned at the first rotation position which is a reference position (that is, a normal rotation position at the time when the rotation of the protective cover 31 is started.

As a result, in the image forming apparatus 100, the rotation of the protective cover 31 can be started from the reference position after the phase shift between the pinion gear 41 and the rack gear 44 is reset, and thus, the protective cover 31 can be returned to the normal operation.

In this way, in the image forming apparatus 100 of the third embodiment, similar to the first embodiment, even when the phases of the pinion gear 41 and the rack gear 44 are shifted, the phase shift between the pinion gear 41 and the rack gear 44 can be reset by opening and closing the upper side opening and closing cover 11, and the operation of the protective cover 31 can be returned to the normal operation.

Further, in the image forming apparatus 100 of the third embodiment, when the upper side opening and closing cover 11 is in the open state, that is, when the protective cover 31 is at the second rotation position, the pinion gear 41 and the rack gear 44 are in a state of being engaged with each other. Therefore, the protective cover 31 can be more firmly held at the second rotation position as compared to the first embodiment, although not to the extent of the second embodiment.

4. Other Embodiments

4-1. Other Embodiment 1

Figure 12:
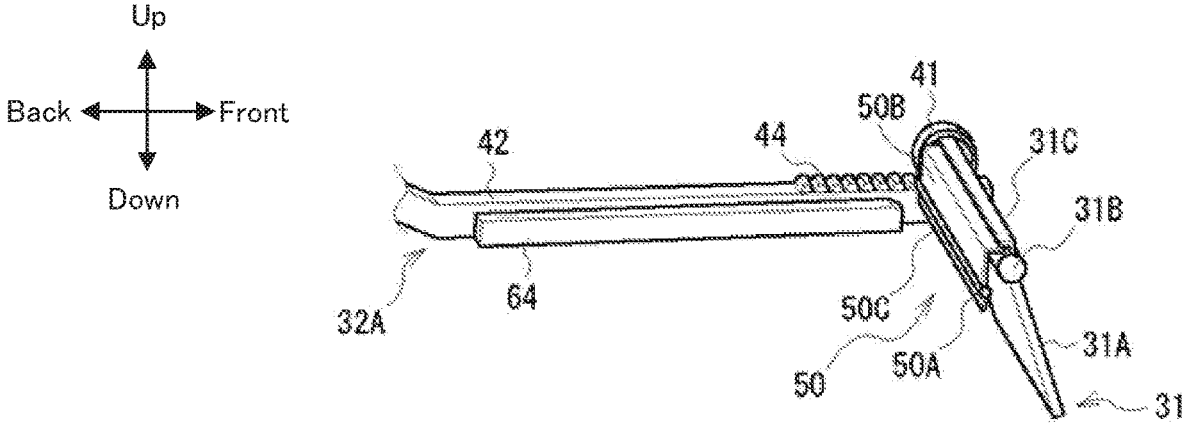
FIG. 12 is a perspective view illustrating a configuration of a stopper according to another embodiment.

In the above-described second embodiment, the stopper 50 that limits the rotation of the protective cover 31 when the protective cover 31 is at the second rotation position is added to the image forming apparatus 1 of the first embodiment. However, the present invention is not limited to this. It is also possible that the stopper 50 is added to the image forming apparatus 100 of the third embodiment. In this case, as illustrated in FIG. 12, the position of the front end of the stopper engagement part 64 on the side surface on the inner side of the link lever 32A may be selected such that, when the pinion gear 41 and the rack gear 44 are engaged with each other and the protective cover 31 is rotated to the second rotation position (that is, when the upper side opening and closing cover 11 is in the open state), the engagement between the link lever engagement part 50C of the stopper 50 and the stopper engagement part 64 of the link lever 32A is released.

In this case, when the protective cover 31 is at the second rotation position, the rotation of the protective cover 31 is limited by the stopper 50 in addition to that the protective cover 31 is held by the engagement between the pinion gear 41 and the rack gear 44. Therefore, in this case, the protective cover 31 can be more firmly fixed at the second rotation position.

4-2. Other Embodiment 2

Further, in the above-described embodiments, the protective cover 31 is rotated in conjunction with the opening and closing operation of the upper side opening and closing cover 11 due to the interlocking part 32 or interlocking part 70 having the link lever 32A, the link member 32B, the pinion gear 41, and the rack gear 44. The present invention is not limited to this. As long as the protective cover 31 can be rotated in conjunction with the opening and closing operation of the upper side opening and closing cover 11, it is also possible to use an interlocking part that has a configuration different from that of the interlocking part 32 or the interlocking part 70.

Further, in the above-described embodiments, the link member 32B is rotated in conjunction with the opening and closing operation of the upper side opening and closing cover 11 by a mechanism not illustrated in the drawings. However, regarding this mechanism, any mechanism, for example, a known mechanism may be used as long as the mechanism allows the opening and closing operation of the upper side opening and closing cover 11 and the rotation of the link member 32B to be interlocked. As a specific example, for example, the link member 32B illustrated in FIG. 2 is biased by a torsion spring or the like (not illustrated in FIG. 2) to rotate in the counterclockwise direction in FIG. 2, and, when the upper side opening and closing cover 11 is in the closed state, the link member 32B is engaged with a stopper (not illustrated in FIG. 2) so that the link member 32B is held at the rotation position illustrated in FIG. 2. Then, when the upper side opening and closing cover 11 opens, the engagement between the link member 32B and the stopper (not illustrated in FIG. 2) is released along with the opening of the upper side opening and closing cover 11 and, due to the biasing force, the link member 32B rotates in the counterclockwise direction in FIG. 2 to slide the link lever 32A.

Further, in the above-described embodiments, due to the engagement between the pinion gear 41 as a first engagement part and the rack gear 44 as a second engagement part, the protective cover 31 is rotated in conjunction with the opening and closing operation of the upper side opening and closing cover 11. The present invention is not limited to this. It is also possible to provide engagement parts different from the pinion gear 41 and the rack gear 44 in the interlocking part 32 or the interlocking part 70 as long as the engagement parts allow switching between an engaged state and a disengaged state along with the opening and closing operation of the upper side opening and closing cover 11. For example, instead of the link lever 32A, it is also possible to provide a cylindrical partially toothed gear having a portion with no gear teeth on a part of an outer peripheral surface thereof. In this case, for example, when the upper side opening and closing cover 11 is in the open state, engagement between the pinion gear 41 and the partially toothed gear is released by rotating the partially toothed gear such that the portion of partially toothed gear with no gear teeth is positioned at a position opposing the pinion gear 41. Then, when the upper side opening and closing cover 11 closes from the open state, the partially toothed gear rotates and the gear teeth of the partially toothed gear reaches the position opposing the pinion gear 41, and thereby, the pinion gear 41 and the partially toothed gear engage with each other.

4-3. Other Embodiment 3

Further, in the above-described first embodiment, when the engagement between the pinion gear 41 and the rack gear 44 is released (that is, when the upper side opening and closing cover 11 is in the open state), the protective cover 31 is in contact with the transfer belt 28 and thereby is held in the state of being positioned at the second rotation position. That is, the transfer belt 28 is used as a positioning means for positioning the protective cover 31 at the reference position.

The present invention is not limited to this. It is also possible that a contact part that is in contact with the protective cover 31 when the engagement between the pinion gear 41 and the rack gear 44 is released is separately provided on the upper side opening and closing cover 11, and this contact part is used as a positioning means.

Further, in the above-described third embodiment, when the engagement between the pinion gear 41 and the rack gear 44 is released (that is, when the upper side opening and closing cover 11 is in the closed state), the protective cover 31 is in contact with the front upper end of the upper side opening and closing cover 11 and thereby is held in the state of being positioned at the first rotation position. That is, the front upper end of the upper side opening and closing cover 11 is used as a positioning means for positioning the protective cover 31 at the reference position.

The present invention is not limited to this. It is also possible that a contact part that is in contact with the protective cover 31 when the engagement between the pinion gear 41 and the rack gear 44 is released is separately provided on the upper side opening and closing cover 11, and this contact part is used as a positioning means.

4-4. Other Embodiment 4

Further, in the above-described embodiments, the present invention is applied to the image forming apparatus 1 or the image forming apparatus 100 having the apparatus main body 10 as an apparatus main body, the upper side opening and closing cover 11 as a rotating member, the protective cover 31 as a protective member protecting a predetermined portion, and the interlocking part 32 or the interlocking part 70 interlocking the rotating member and the protective member. However, in addition to image forming apparatuses such as a printer, a copier, a facsimile, and a multifunction machine, the present invention is also applicable to various information processing apparatuses such as a personal computer and a game machine, as long as the apparatuses each have an apparatus main body, a rotating member, a protective member and an interlocking part.

4-5. Other Embodiment 5

Further, in the above-described embodiments, the upper side opening and closing cover 11 is used as a specific example of a rotating member or an opening and closing member of an information processing apparatus. However, the present invention is not limited to this. It is also possible to use a rotating member or an opening and closing member different from the upper side opening and closing cover 11 as long as the rotating member is provided rotatable with respect to an apparatus main body or the opening and closing member is provided openable and closeable with respect to an apparatus main body. Further, in the above-described embodiments, the protective cover 31 is used as a specific example of a protective member of an information processing apparatus. However, the present invention is not limited to this. It is also possible to use a protective member different from the protective cover 31 as long as the protective member protects a predetermined portion by rotating in conjunction with a rotating member. Further, in the above-described embodiments, the link lever 32A is used as a specific example of a sliding member of an information processing apparatus. However, the present invention is not limited to this. It is also possible to use a sliding member different from the link lever 32A as long as the sliding member slides in conjunction with an opening and closing operation of an opening and closing member. Further, in the above-described embodiments, the transfer belt 28 is used as a specific example of a transfer part of an information processing apparatus. However, the present invention is not limited to this. It is also possible to use a transfer part different from the transfer belt 28 as long as the transfer part transfers an image formed by an image forming part to a medium.

4-6. Other Embodiment 6

Further, the present invention is not limited to the above-described embodiments. That is, the application scope of the present invention also covers embodiments obtained by arbitrarily combining some or all of the above-described embodiment and other embodiments, and embodiments obtained by extracting some of the above-described embodiment and other embodiments.

The present invention can be widely used in an information processing apparatus having a protective member interlocking with a rotating member such as an opening and closing unit or an opening and closing cover.

LEGENDS

1, 100: image forming apparatus
10: apparatus main body
11: upper side opening and closing cover
22*p*: image forming part
28: transfer belt
31: protective cover
32, 70: interlocking part
32A: link lever
32B: link member
40, 101: torsion spring
41: pinion gear
44: rack gear
50: stopper
64: stopper engagement part

What is claimed is:

1. An information processing apparatus, comprising:
an apparatus main body;
an opening and closing member that opens and closes the apparatus main body;
a protective member that rotates along with the opening and closing of the opening and closing member to protect a predetermined portion and that includes a first engagement part;
an interlocking part that interlocks the opening and closing member and the protective member and that includes a second engagement part that engages with the first engagement part of the protective member; and
a biasing member that biases the protective member in a direction towards a reference position, wherein
during a transition of the opening and closing member from a closed state to an open state,
the interlocking part releases the engagement of the first engagement part and the second engagement part, and
then the protective member rotates to the reference position by biasing of the biasing member, and
during a transition of the opening and closing member from the open state to the closed state,
the interlocking part causes the first engagement part and the second engagement part to re-engage with each other in a state in which the protective member is positioned at the reference position,
the first engagement part of the protective member is a pinion gear,
the interlocking part includes:
a sliding member that slides in conjunction with the opening and closing of the opening and closing member; and
a rack gear as the second engagement part that is provided in the sliding member, the sliding member includes
a first portion where the rack gear is formed, and
a second portion where the rack gear is not formed,
the first and second portions of the sliding member is provided adjacent to each other in a sliding direction, and
when the second portion where the rack gear is not formed slides to a position opposing the pinion gear, engagement between the rack gear and the pinion gear is released.

2. The information processing apparatus according to claim 1, wherein
the protective member and the predetermined portion protected by the protective member are provided in the opening and closing member, and
the protective member is in contact with or adjacent to the predetermined portion when the opening and closing member is in the open state, and thereby protects the predetermined portion and is positioned at the reference position.

3. The information processing apparatus according to claim 1, wherein the interlocking part further includes:

a disk-shaped link member that rotates along with the rotation of the opening and closing member, the link member having a projection part provided on a circumference of the link member; and a link lever that extends from the slide member and is connected to the projection part, a direction of the extension of the link lever being inclined relative to a sliding direction of the slide member, when the opening and closing member rotates to open, the disk-shaped link member rotates in a direction opposite from a rotational direction of the opening and closing member, causing the link lever to slide on the projection part and thereby the slide member to slide in the sliding direction away from the protective member.

4. The information processing apparatus according to claim 1, further comprising:

a stopper that limits rotation of the protective member, wherein the stopper limits the rotation of the protective member by engaging with the protective member when the opening and closing member is in the open state in which the opening and closing member is open with respect to the apparatus main body, and, when the opening and closing member transitions from the open state to the closed state, the engagement between the stopper and the protective member is released along with the transition of the opening and closing member.

5. The information processing apparatus according to claim 4, wherein the protective member is rotatably provided with respect to the opening and closing member, the stopper is rotatably provided with respect to the opening and closing member and is biased in a direction of engagement with the protective member, the sliding member has a stopper engagement part that engages with the stopper to rotate the stopper in an opposite direction with respect to the direction of engagement with the protective member, when the opening and closing member is in the open state in which the opening and closing member is open with respect to the apparatus main body, the engagement between the stopper engagement part and the sliding member is released, and thereby, the stopper rotates in the direction of engagement with the protective member to engage with the protective member, and when the opening and closing member transitions from the open state to a closed state, the stopper rotates in an opposite direction with respect to the direction of engagement with protective member by engaging with the stopper engagement part of the sliding member, thereby releasing the engagement with the protective member.

6. The information processing apparatus according to claim 5, wherein the protective member includes a first L-shaped section having a section extending towards a rear side of the opening and closing member, the stopper includes a second L-shaped section having a section extending towards a front side of the opening and closing member, and when the stopper engages with the protective member, the section of the second L-shaped section of the stopper positions under the section of the first L-shaped section of the protective member.

7. The information processing apparatus according to claim 1, wherein the apparatus main body has an image forming part that forms an image using a developer, the opening and closing member has a transfer part that transfers the image formed by the image forming part to a medium, the transfer part is provided so as to face the image forming part when the opening and closing member is in a closed state in which the opening and closing member is closed with respect to the apparatus main body, and the protective member protects the transfer part when the opening and closing member is in an open state in which the opening and closing member is open with respect to the apparatus main body.

8. The information processing apparatus according to claim 1, wherein the opening and closing member is rotatable about a first rotational axis, the protective member rotates about a second rotational axis, the second rotational axis being different from the first rotational axis, the interlocking part is connected to the opening and closing member, a connecting point of the interlocking part to the opening and closing member is movable in a rotational direction around the first rotational axis of the opening and closing member, and when the opening and closing member rotates, the interlocking part moves and causes the protective member to rotate.

9. An information processing apparatus, comprising:

an apparatus main body;

an opening and closing member that opens and closes the apparatus main body;

a protective member that rotates along with the opening and closing of the opening and closing member to protect a predetermined portion and that includes a first engagement part;

an interlocking part that interlocks the opening and closing member and the protective member and that includes a second engagement part that engages with the first engagement part of the protective member; and a biasing member that biases the protective member in a direction towards a reference position, wherein during a transition of the opening and closing member from an open state to a closed state, the interlocking part releases the engagement of the first engagement part and the second engagement part, and then the protective member rotates to the reference position by biasing of the biasing member, and during a transition of the opening and closing member from the closed state to the open state, the interlocking part causes the first engagement part and the second engagement part to re-engage with each other in a state in which the protective member is positioned at the reference position.

10. The information processing apparatus according to claim 9, wherein the protective member and the predetermined portion protected by the protective member are provided in the opening and closing member, and the protective member protects the predetermined portion when the opening and closing member is in the open state.

11. The information processing apparatus according to claim 9, wherein the opening and closing member is rotatable about a first rotational axis, the protective member rotates about a second rotational axis, the second rotational axis being different from the first rotational axis, the interlocking part is connected to the opening and closing member, a connecting point of the interlocking part to the opening and closing member is movable in a rotational direction around the first rotational axis of the opening and closing member, and when the opening and closing member rotates, the interlocking part moves and causes the protective member to rotate.

* * * * *